United States Patent [19]

Harada

[11] Patent Number: 4,694,288

[45] Date of Patent: Sep. 15, 1987

[54] MULTIWINDOW DISPLAY CIRCUIT

[75] Inventor: Munenori Harada, Sakai, Japan

[73] Assignee: Sharp Kabushiki Kaisha, Osaka, Japan

[21] Appl. No.: 647,527

[22] Filed: Sep. 5, 1984

[30] Foreign Application Priority Data

Sep. 14, 1983 [JP] Japan ..... 58-170973

[51] Int. Cl.[4] ..... G09G 1/16

[52] U.S. Cl. ..... 340/721; 340/724; 340/747

[58] Field of Search ..... 340/721, 747, 723, 724

[56] References Cited

U.S. PATENT DOCUMENTS

| | | | |
|---|---|---|---|
| 4,278,973 | 7/1981 | Hughes et al. | 340/721 |
| 4,414,628 | 11/1983 | Ahuja et al. | 340/721 |
| 4,533,910 | 8/1985 | Sukonick et al. | 340/798 |
| 4,542,376 | 9/1985 | Bass et al. | 340/721 |
| 4,550,315 | 10/1985 | Bass et al. | 340/721 |
| 4,555,775 | 11/1985 | Pike | 340/734 |
| 4,559,533 | 12/1985 | Bass et al. | 340/721 |
| 4,586,035 | 4/1986 | Baker et al. | 340/712 |

*Primary Examiner*—Marshall M. Curtis

*Attorney, Agent, or Firm*—Birch, Stewart, Kolasch & Birch

[57] ABSTRACT

A multiwindow display circuit comprises a horizontal boundary memory for storing horizontal boundary data of display windows, a vertical boundary memory for storing vertical boundary data of the display windows, a display address memory for storing an address of each of the display windows, a picture information memory for storing picture information related to the address stored within the display address memory, a bias value memory for storing bias values for the display windows, an address converter for adding a selected one of the bias values to the address of the display address memory to convert the display address, a window select circuit for selecting a single window from among the display windows, a display timing controller for changing a code representative of the single window, and a display responsive to the display timing controller for displaying any portion of the picture information memory in any area of the display.

4 Claims, 14 Drawing Figures

MULTIWINDOW DISPLAY CIRCUIT

BACKGROUND OF THE INVENTION

The present invention relates to a display circuit and, more particularly, to a multiwindow display circuit in which a plurality of displays are windowed in a single frame.

A multiwindow display, for example, in a computer is used to divide the display screen into a plurality of display sections or windows in which the respective pictures are displayed, called a multiwindow.

FIG. 1(B) is a schematic drawing of a conventional multiwindow picture, in which a single picture frame is divided into "n" windows. FIG. 1(A) is a memory format for windowing the displays of FIG. 1(B). Conventionally the memory must store a plurality of items of picture information identically and respectively corresponding to the windowed pictures. Therefore, to reverse or blink at least one of the windowed displays, the memory contents must be changed so as to identically and respectively correspond to the windows. This is disadvantageous to circuit design.

SUMMARY OF THE INVENTION

Accordingly, it is an object of the present invention to provide an improved multiwindow display circuit for easily and speedily reversing or blinking windowed pictures.

It is another object of the present invention to provide an improved bias register for a multiwindow display circuit for easily and speedily reversing or blinking windowed pictures.

It is a further object of the present invention to provide an improved priority register for a multiwindow display circuit for selecting window priority data, so that divided pictures are windowed with priority and can be partially overlapped.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To provide the above objects, according to a preferred embodiment of the present invention, a multiwindow display circuit comprises horizontal frame memory means for storing horizontal boundary data of display windows, vertical frame memory means for storing vertical boundary data of the display windows, display address means for storing an address of each of the display windows, picture information means for storing picture information related to the address stored in the display address means, bias value memory means for storing each bias value for the display windows, address converter means for adding a selected one of the bias values to the address of the display address means to convert the display address, window select means for selecting a single window from among the display windows, display timing control means for changing a code representative of the single window, and display means responsive to the converted address for displaying any portion of the picture information at any area of the display means. Priority means is provided for selecting to partially overlap the display windows with priority.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 2:
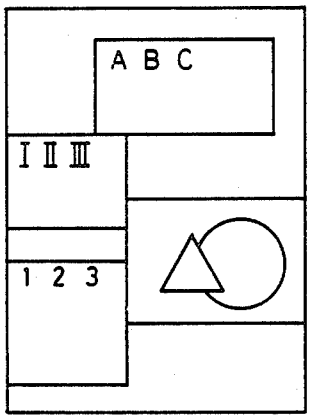
FIGS. 2(A) and 2(B) are schematic drawings of memory contents and a mulitiwindowed picture, according to a preferred embodiment of the present invention, respectively.
Figure 2:
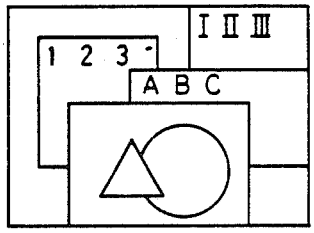

FIGS. 2(A) and 2(B) show a format of a memory and a multiwindow picture according to a preferred embodiment of the present invention, respectively. A plurality of items of picture information for a multiwindow are stored, in a random access memory, within a plurality of memory portions, as shown in FIG. 2(A), so that the multiwindow picture of FIG. 2(B) can be enabled. The divided pictures can be reversed or blinked according to the present invention.

Figure 3:
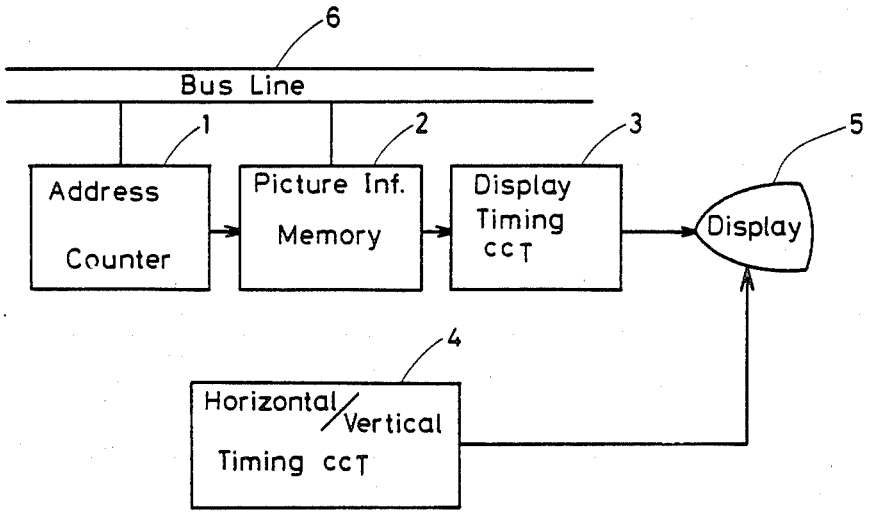
FIG.3 BACKGROUND ART
FIG. 3 is a block diagram of a conventional multiwindow display circuit.

FIG. 3 is a block diagram of a conventional multiwindow display circuit. The circuit comprises an address counter 1, a picture information memory 2, a display timing circuit 3, a horizontal/vertical timing circuit 4, and a display 5. A bus line 6 is provided for coupling the address counter 1 and the picture information memory 2. The address counter 1 is provided for sequentially selecting the contents of the picture information memory 2, so that the contents are subjected to the timing control by the display timing circuit 3 and the horizontal/vertical timing circuit 4 to display the contents in the display 5.

Figure 1:
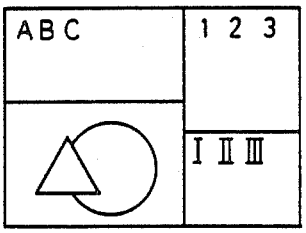
FIG.1 (A) BACKGROUND ART
FIGS. 1(A) and 1(B) are schematic drawings of conventional memory contents and a conventional mulitiwindowed picture, respectively.
Figure 1:
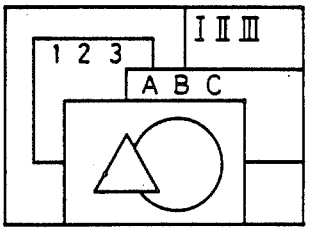
FIG.1 (B) BACKGROUND ART

Since the address counter 1 merely sequentially selects the contents of the picture information memory 2, the picture information memory 2 must store identically and respectively corresponding information as shown in FIG. 1(A) to display the multiwindow of FIG. 1(B).

According to the present invention, it is unnecessary for the picture information memory 2 to store picture information identically and respectively corresponding to the display contents. And, it is possible for desired parts of the picture information to be overlapped to display the multiwindow.

Figure 4:
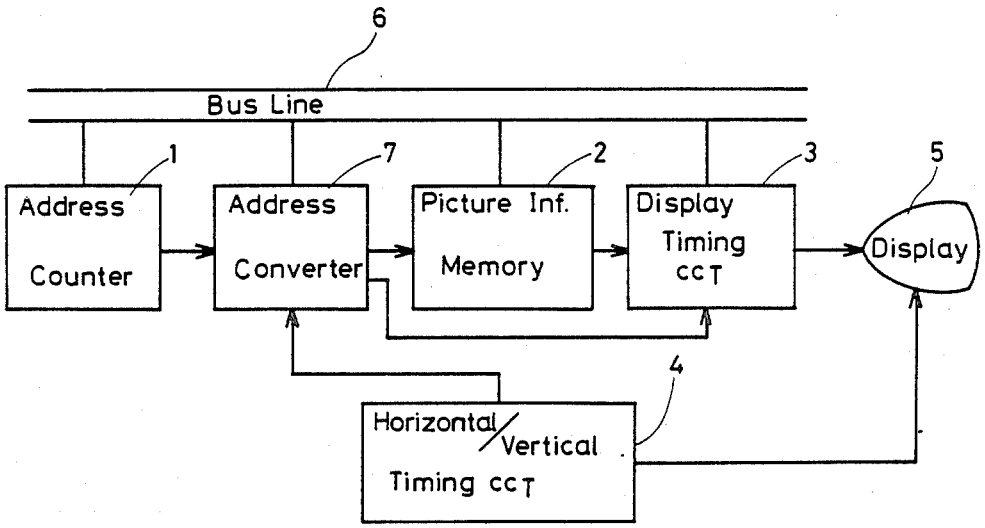
FIG. 4 is a block diagram of a multiwindow display circuit according to the preferred embodiment of the present invention.

FIG. 4 is a block diagram of a multiwindow display circuit according to the first preferred embodiment of the present invention. Like elements corresponding to those of FIG. 3 are indicated by like numerals.

According to the present invention, an address converter 7 is interposed between the address counter 1 and the picture information memory 2. Rather than sequentially selecting the picture information in order, the address converter 7 can freely change the addresses for directing each of the items of the picture information, so that any desired address of the picture information can be selected and displayed.

Figure 5:
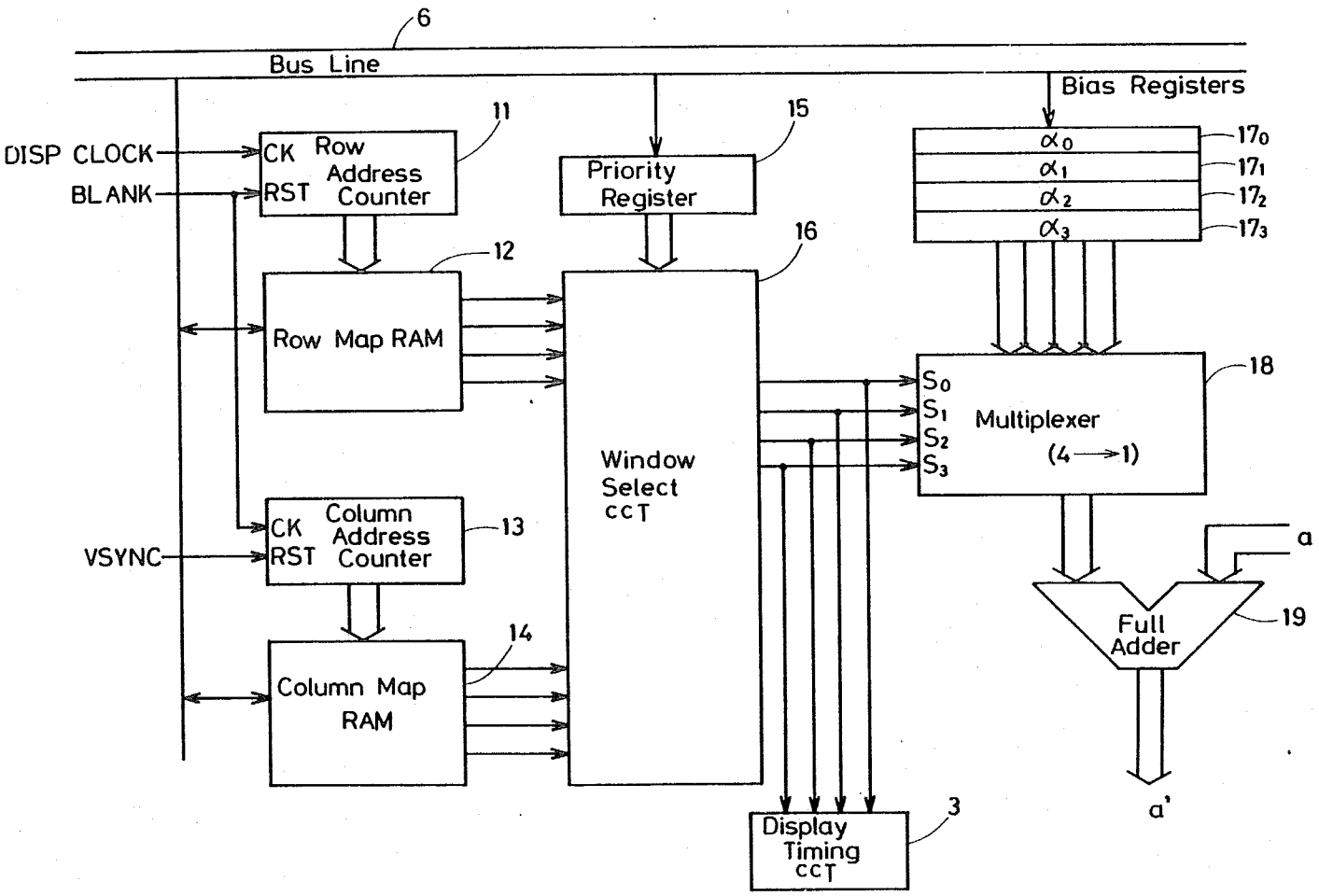
FIG. 5 is a block diagram of an address converter according to the preferred embodiment of the present invention.
Figure 6A:
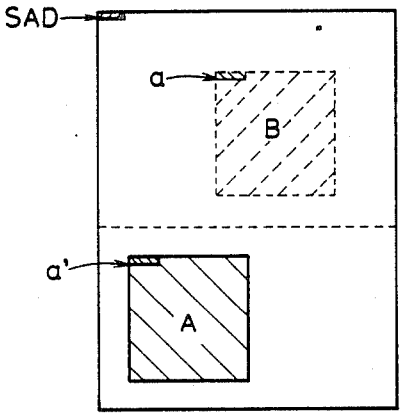
FIGS. 6(A) and 6(B) are schematic drawings of memory contents and the multiwindowed picture according to the preferred embodiment of the present invention.
Figure 6B:
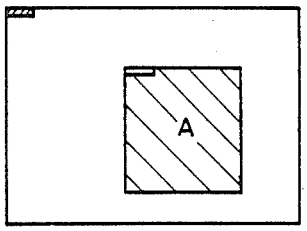

FIG. 5 is a block diagram of the address converter 7 of FIG. 4. FIGS. 6(A) and 6(B) are a schematic format of the picture information memory 2 and a multiwindow display, respectively, display of the picture information being performed by converting the address with the address converter 7.

Conventionally, a display start address "SAD" and its following addresses which are all positioned above the dotted line of FIG. 6(A) relate to picture information to be displayed in the display 5. To display the display of FIG. 6(B) in which the memory area "A" is displayed at the window display, the memory area "A" is shifted to the memory area "B". For this purpose, the address for directing the memory area "B" is changed to be for directing the memory area "A". The leading address of the memory area "B" is assumed to be a while the leading address of the memory area "A" is assumed to be a'. It is assumed that $a'-a=\text{alpha}$.

When the address counter becomes "alpha", starting with the display start address SAD, the bias value "alpha" is added as follows:

$a+\text{alpha}=a'$

This means that the memory contents of the memory area "A" are displayed at the previous display area for the memory area "B", so that the display of FIG. 6(B) can be enabled.

However, such information is not sufficient because of the absence of information for indicating the location of memory area "A" is limited. This area limitation is referred to as a "window". The display 5 only displays the picture information corresponding to the memory area "A" and its surrounding display to display a single picture frame.

Referring now to FIG. 5, to determine the "window" area, a row address counter 11, a row map random access memory (RAM) 12, a column address counter 13, a column map RAM 14, a priority register 15, and a window select circuit 16 are provided. The row address counter 11 is responsive to the display clocks signal ("DISP CLOCK") which provide counter clock signals, and horizontal and vertical blanking signals "BLANK" which provide reset signals for horizontally counting the display screen. The column address counter 13 is responsive to the horizontal and vertical blanking signals "BLANK" which provide clock signals and vertical synchronizing signals "VSYNC" which provide reset signals for vertically counting the display screen.

Figure 7:
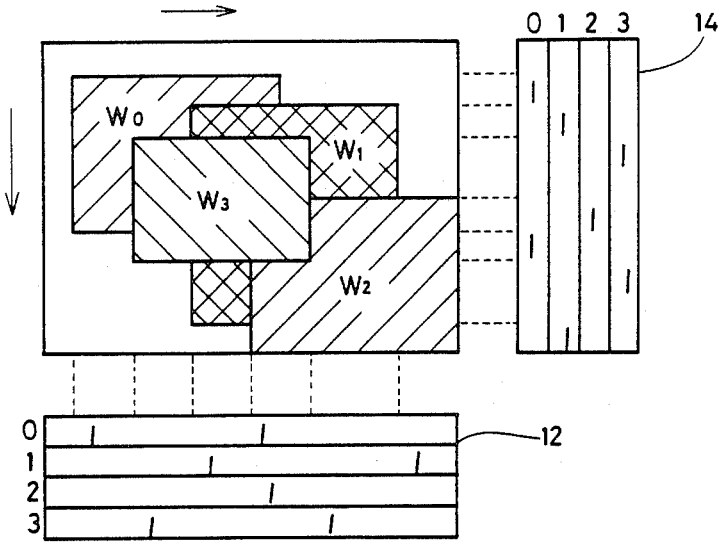
FIG. 7 is an explanatory drawing of a row map RAM and a column map RAM connected in the circuit of FIG. 5.

FIG. 7 is an explanatory drawing of a memory format of each row map RAM 12 and column map RAM 14 in conjuction with a multiwindow picture. As shown in FIG. 7, the row map RAM 12 acts as a first display boundary memory for storing horizontal corner points of divided windows W0–W3, with the column map RAM 14 acting as a second display boundary memory for storing vertical corner points of the divided windows W0–W3. To define a single divided window, each of the display boundary memories stores some points representative of the windows four corners. A plurality of bias registers $17_0$–$17_3$ are provided for storing bias values for address conversion. A multiplexer 18 is responsive to the signals from the window select circuit 16 and the bias values from the bias registers 17 for selecting each of the bias values to be added to each of the addresses. A full adder 19 is provided for adding each of the bias values to each of the addresses.

Figure 8:
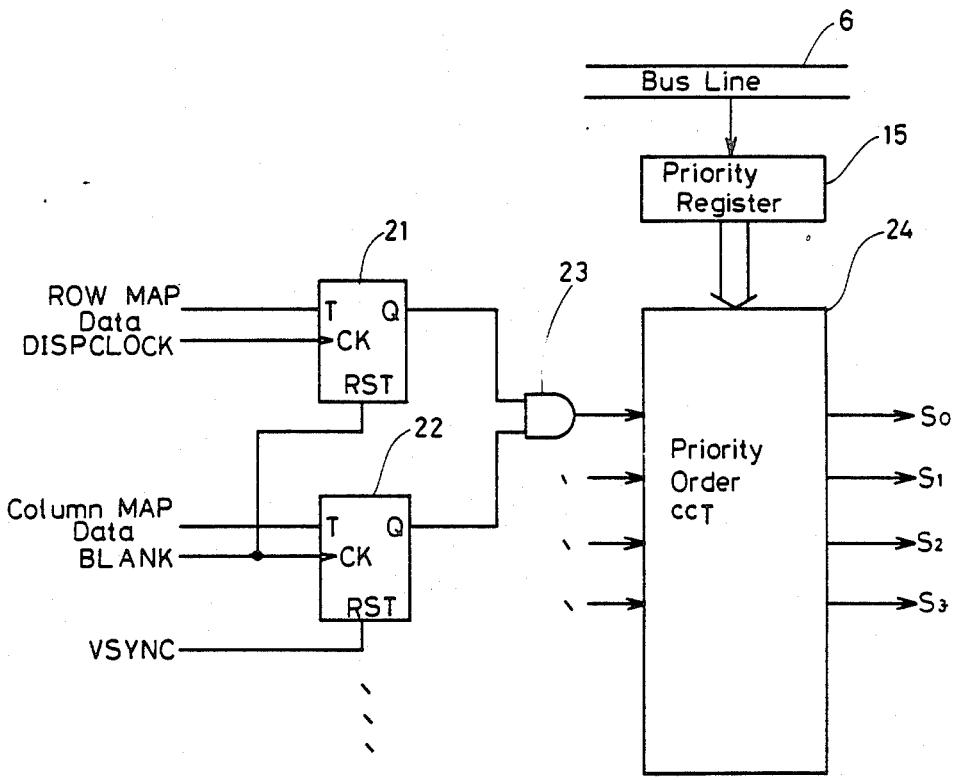
FIG. 8 is a block diagram of a window select circuit connected in the circuit of FIG. 5.

FIG. 8 is a block diagram of the window select circuit 16. The window select circuit 16 comprises two T-type flip-flops 21 and 22, and an AND gate 23. Once the row map RAM 12 outputs row map data on a high level "1" to the T-type flip-flop 21 and the column map RAM 14 outputs column map data on the high level "1" to the T-type flip-flop 22, the window select circuit 16 becomes activated. Actuation of window select circuit 16 occurs before the next high level data ("1") are input into the T-type flip-flops 21 and 22. Unless both of the row map data and the column map data are high (at the "1" level), the relevant window cannot be selected. More particularly, responsive to the row map data and the column map data both being high (at the "1" level), the T-type flip-flops 21 and 22 develop their Q outputs on the hogh level "1" prior to the next data of the "1" level bing input into the T-type flip-flops 21 and 22. The AND gate 23 is responsive to the high level outputs of "1" of the T-type flip-flops 21 and 22 for developing its high level output of "1". Thus, the AND gate 23 outputs the high level output whenever the data area is included within the respective window area of FIG. 7. When four windows are used, four sets of the T-type flip-flops 21 and 22, and the AND gate 23 are needed.

When a plurality of window information is passed through the flip-flops 21 and 22, and the AND gate 23, the windows may be partially overlapped. The priority register 15 is provided for selecting the priority of partially overlapping windows with priority. Responsive to the priority register 15, a priority order circuit 24 is operated to decide the overlapping order. The priority order circuit 24 selects a single window from the plurality of windows. One of the bias registers $17_0$–$17_3$ corresponding to the selected window numbers S0–S3 of the selected window is selected by the multiplexer 18. The full adder 19 is operated for adding one of the bias values "$\text{alpha}_0$–$\text{alpha}_3$" to the address a of each of the address counters 11 and 13. Thus, the address a' is obtained, accessing a location of the picture information memory to display a multiwindow.

Figure 9:
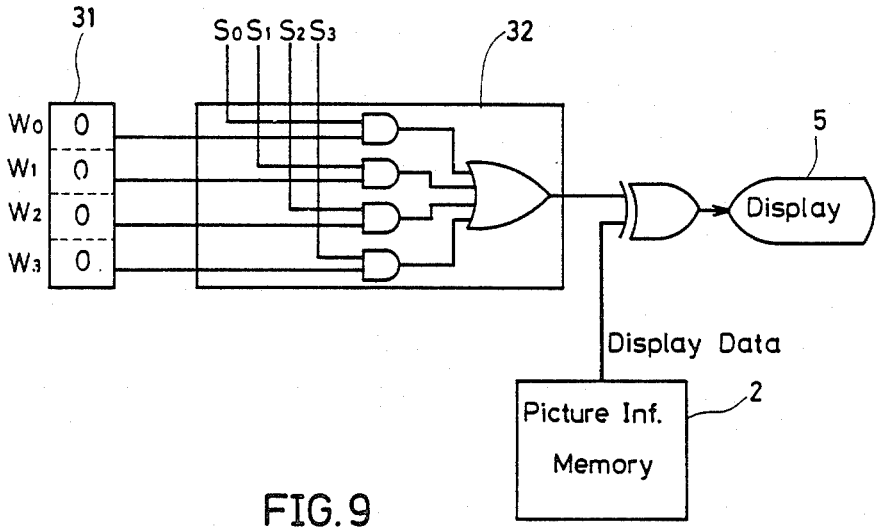
FIG. 9 is a block diagram of a display timing circuit connected to the circuit of FIG. 5.

FIG. 9 is a block diagram of the display timing circuit 3 connected to the circuit of FIG. 5. The display timing circuit 3 comprises an I/O port 31 and a window switching circuit 32. The circuit 3 is connected to the picture information memory 2, and the display 5 through an NOR gate. The I/O port 31 is provided for selecting the switching of normal/reverse conditions of each of the windows by changing thecode signals of the window number signals S0–S3. The window switching circuit 32 includes four AND gates and an OR gate. The window number signals S0–S3 are applied to the AND gates.

Both the row map RAM 12 and the column map RAM 14 provide map data for defining which window is to be selected. The multiplexer 18 is responsive to a selected one of the window numbers S0–S3, causing one of the bias registers $17_0$–$17_3$ to develop its bias value corresponding to the selected one of the window numbers S0–S3. The full adder 19 is operated to add the bias value among "$alpha_0$–$alpha_3$" to the address a from each of the address counters 11 and 13. Thus, the address a′ is obtained, accessing a location of the window picture information to be displayed.

Since the contents of the row map RAM 12, the column map RAM 14, the priority register 15, and the bias registers $17_0$–$17_3$ can be freely renewed by programming, any desired portion of the picture information memory can be reversed or blinked in any portion of the display screen simply by programming and selecting the contents of the I/O port 31. The multiwindow can be promptly reversed or blinked without changing the contents of the picture information memory 2.

Figure 10:
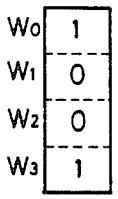
FIG. 10 is an explanatory drawing of the contents of an I/O port connected in the circuit of FIG. 9.
Figure 11:
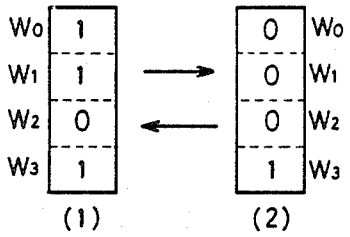
FIG. 11 is an explanatory drawing of changes in the contents of the I/O port of FIG. 10.

For example, to make the windows W0 and W3 be displayed in reverse video while windows W1 and W2 remain normally displayed, the contents of the I/O port 31 are programmed as shown in FIG. 10. To make the windows W0 and W1 blinking while the window W2 remains normally displayed, and the window W3 is displayed in reverse video, the contents of the I/O port 31 are alternatively programmed as the contents (1) and (2) of FIG. 11 for a predetermined time.

It may be evident that the number of the multiwindow should not be limited to four.

The application of the multiwindow display circuit according to the present invention can be applied to any display including a character display, a bit map display, a cathode ray tube (CRT), an electroluminescent display (EL), and a plasma display.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A multiwindow display circuit comprising:

display means for displaying a plurality of display windows;

horizontal frame memory means for storing horizontal boundary data for each one of said plurality of display windows;

vertical frame memory means for storing vertical boundary data for each one of said plurality of display windows;

display address means for sequentially producing an initial address for each one of said plurality of display windows;

picture information memory means for storing picture information corresponding to each said initial address;

window selection means, responsive to said horizontal frame memory means and said vertical frame memory means, for selecting a particular display window from said plurality of display windows, said particular display window being selected when said initial address data is determined by said window selection means to be in said horizontal and vertical boundary data for said particular display window;

bias value memory means for storing a plurality of bias values for each one of said plurality of display windows, each one of said bias values representing the boundary data defined by said horizontal frame memory means and said vertical frame memory means of said window selection means;

address converter means for adding a selected one of said bias values corresponding to the selected display window to said initial address produced by said display address means to obtain a desired display address, said desired display address then being provided to said picture information memory means to access corresponding picture information; and display timing control means, responsive to said window selection means, for providing a code representative of the selected display window to said display means for directing the display of said selected window, and controlling the supply of accessed picture information to said display means;

said display means being responsive to said code provided by said display timing means and said supplied picture information, whereby any portion of said picture information stored in said picture information memory means can be displayed on any display window of said display means.

2. The circuit of claim 1, wherein said display timing control means includes control means, responsive to said code, for reversing or blinking the selected said particular display window.

3. The circuit of claim 1, wherein said address converter means includes multiplexer means, responsive to said horizontal frame memory means, said vertical frame memory means, said display address means, and said bias value memory, for selecting one of said bias values in said bias value memory to be added to said initial address produced by said display address means.

4. The circuit of claim 1, further comprising priority means for selecting between overlapping said display windows based upon the priority of said display windows.

* * * * *